US009131812B2

(12) United States Patent
Peng

(10) Patent No.: US 9,131,812 B2
(45) Date of Patent: Sep. 15, 2015

(54) METHOD TO MEASURE, INSTALL AND FIX A TOILET SEAT

(71) Applicant: BOLANE COMFORTECHCO., LTD, Changhua County (TW)

(72) Inventor: Shao-Yu Peng, Changhua County (TW)

(73) Assignee: B-O-LANE COMFORTECH CO., LTD., Changhua County (TW)

( * ) Notice: Subject to any disclaimer, the term of this patent is extended or adjusted under 35 U.S.C. 154(b) by 239 days.

(21) Appl. No.: 14/018,856

(22) Filed: Sep. 5, 2013

(65) Prior Publication Data

US 2014/0083594 A1 Mar. 27, 2014

(30) Foreign Application Priority Data

Sep. 26, 2012 (TW) ..... 101135188 A

(51) Int. Cl.
*A47K 13/00* (2006.01)
*A47K 13/26* (2006.01)

(52) U.S. Cl.
CPC ..... *A47K 13/00* (2013.01); *A47K 13/26* (2013.01)

(58) Field of Classification Search
CPC ..... A47K 13/00; A47K 13/26; A47K 13/28; B29C 65/48; E03D 11/13
USPC ..... 156/64, 360, 379; 4/234, 235, 236, 237, 4/238, 239, 240, 253
See application file for complete search history.

(56) References Cited

U.S. PATENT DOCUMENTS

| | | | | |
|---|---|---|---|---|
| 7,150,049 | B1 * | 12/2006 | Fitch | 4/246.1 |
| 2009/0013454 | A1 * | 1/2009 | Landsberger et al. | 4/237 |
| 2010/0065203 | A1 * | 3/2010 | Tanbour et al. | 156/285 |

* cited by examiner

*Primary Examiner* — George Koch
(74) *Attorney, Agent, or Firm* — Chun-Ming Shih

(57) ABSTRACT

A method to measure, install and fix a toilet seat provides a contour measurement device, which includes a toilet seat contour line and a mounting base contour line, and depends on a process of shifting the toilet seat contour line on the contour measurement device along a boundary contour of a flush toilet and referring to these two contours as a basis to decide a location of the toilet seat and a fixed location of the mounting base contour line for a mounting base to be installed. Moreover, the mounting base is provided with a reusable adhesive medium which is fixed at a bottom surface and used to repeatedly stick the mounting base on a flush toilet without damage.

6 Claims, 9 Drawing Sheets

METHOD TO MEASURE, INSTALL AND FIX A TOILET SEAT

BACKGROUND OF THE INVENTION

1. Field of the Invention

The present invention relates to a method to measure, install and fix an object, particular a method to measure, install and fix a toilet seat.

2. Description of the Prior Art

Currently, an ordinary toilet seat or a computerized toilet seat to be installed on a flush toilet should make a holder fixed at two mounting holes of the flush toilet with bolts, washers and nuts by a worker using a wrench or a screw driver in an inconvenient or time-consuming course of assembling or disassembling the toilet seat or the computerized toilet seat that may be unseparated in the case of bolts or nuts rusted.

In addition, a holder of any toilet seat or computerized toilet seat being available in the market and featuring its particular specifications should be lifted gently to check secure fastening after the toilet seat or the computerized toilet seat was installed on a flush toilet. In order to provide a mounting base of the computerized toilet seat available to any flush toilet made by an unspecified manufacturer, some tolerances have to be designed on a holder's mounting holes for flexible adjustment within certain extents. However, it is possible to open more mounting holes by a user in the case of two mounting holes' positions beyond the tolerances; otherwise, the toilet seat fails to be assembled.

SUMMARY OF THE INVENTION

The object of the present invention is to provide a method to measure, install and fix a toilet seat comprising a mounting base which has a lower lateral surface coated with a reusable glutinous substance and is lifted and stuck on a flush toilet securely and repeatedly.

The other object of the present invention is to provide a method as well as a device to easily measure, install and fix a toilet seat on a flush toilet based on adherence.

The further object of the present invention is to provide a method as well as a device to easily measure, install and fix a toilet seat on a flush toilet based on absorption or adherence.

The method to measure, install and fix a toilet seat for above purposes is to measure proper locations of a toilet seat installed on a flush toilet and the toilet seat's mounting base placed on a fixed surface at a flush toilet's rear part according to steps as follows:

Give a contour measurement device on which a toilet seat's contour line and a mounting base's contour line within the toilet seat's contour line are shown;

Shift the toilet seat's contour line on the contour measurement device along a boundary contour of a flush toilet on which a toilet seat will be installed, refer to the toilet seat's contour line and the boundary contour as a basis to decide a location of the toilet seat and a fixed location of the mounting base's contour line for the mounting base to be installed;

Take the mounting base over the fixed location of the mounting base's contour line, lower the mounting base and align the mounting base and the mounting base's contour line, and make the mounting base securely adhere to a fixed surface at the rear part of the flush toilet by way of an adhesive medium at the bottom of the mounting base

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 2:
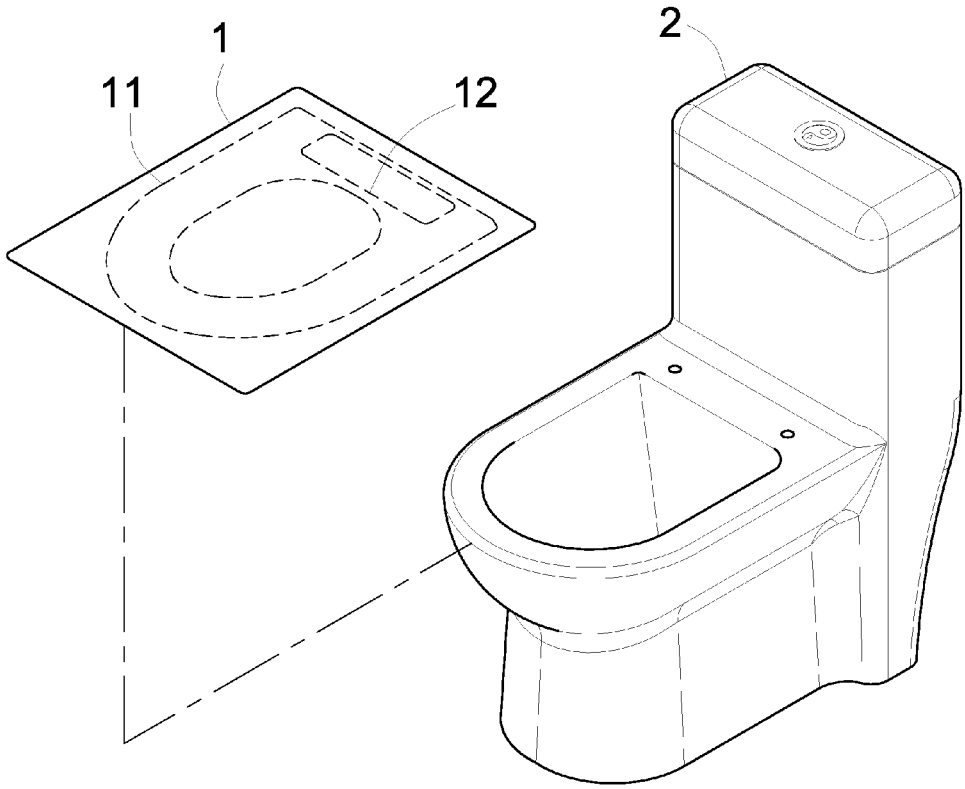
FIG. 2 is a schematic view illustrating a method to measure a flush toilet for installing and fixing a toilet seat based on the contour measurement device in the first embodiment.

Refer to FIG. 2 which illustrates the present invention of a method to measure, install and fix a toilet seat, comprising a contour measurement device 1 and a toilet seat 3 with a mounting base 31 thereon.

Figure 8:
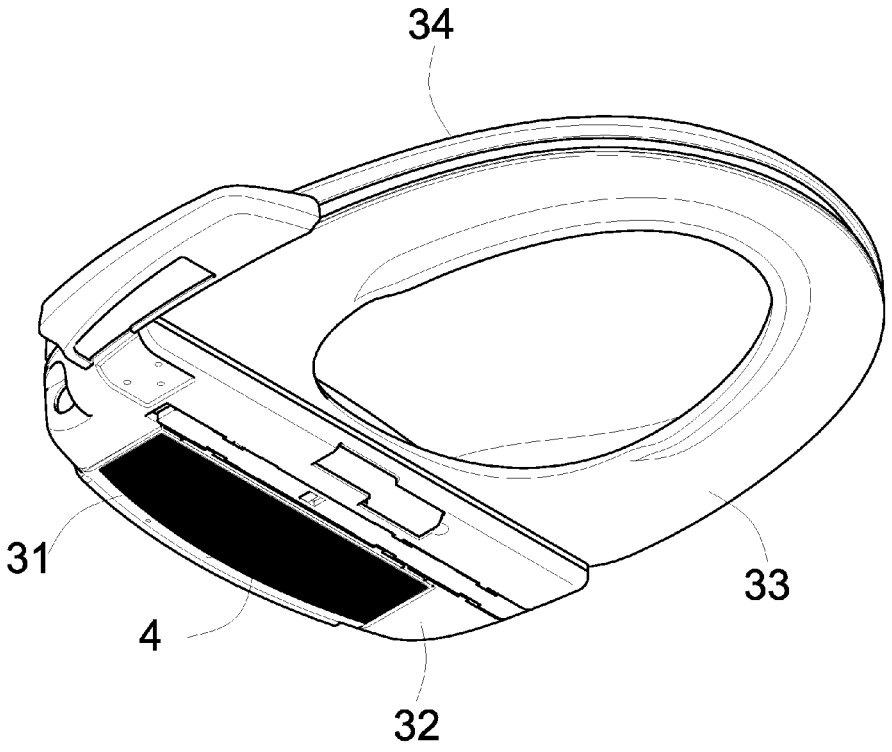
FIG. 8 is a perspective view illustrating the bottom of a toilet seat.

The toilet seat 3 with the mounting base 31 thereon in the present invention can be either an ordinary toilet seat 3 or a computerized toilet seat 3, which is taken as an example to present an installation process of the present invention. As shown in FIG. 8, the computerized toilet seat 3 comprises a mounting base 31, a main body 3, a lavatory seat 33 and a toilet lid 34: the mounting base 31 is located at the bottom edge of the main body 3; the main body 3 relies on the mounting base 31 to securely adhere to a fixed surface at the rear part of a flush toilet 2; the lavatory seat 33 links the leading edge of the main body 3 and is sat by a flush toilet user.

Figure 1:
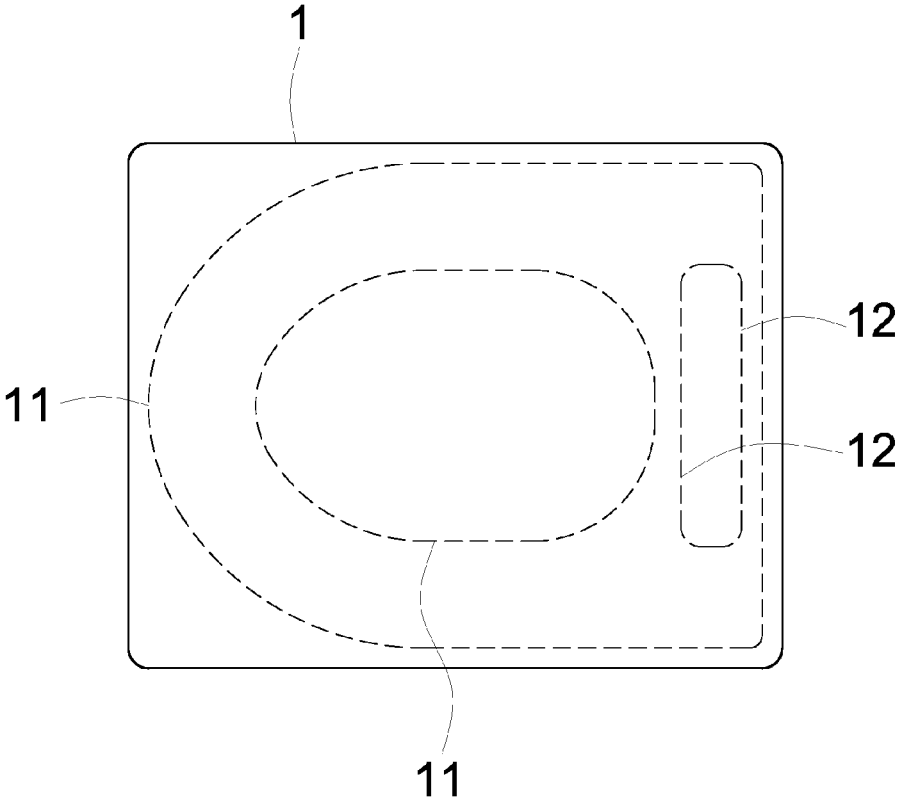
FIG. 1 is a schematic view illustrating a contour measurement device of the present invention in the first embodiment.
Figure 4:
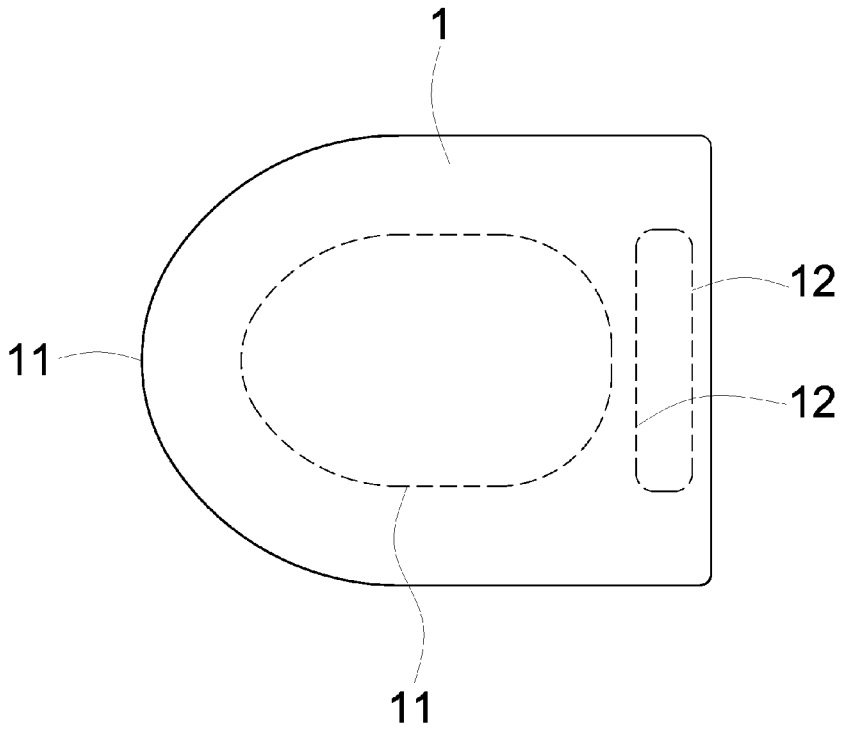
FIG. 4 is a schematic view illustrating a contour measurement device of the present invention in the second embodiment.

The contour measurement device 1 can be a transparent medium, a translucent medium or a display unit with a video camera installed: the medium is made from plant fibers or chemical fibers (e.g., paper or cloth) or a plastic material such as plastic fiber, plastic paper, plastic cloth, plastic sheet, and plastic piece. The medium further comprises at least a toilet seat's contour line 11 and at least a mounting base's contour line 12 which are available for the present invention in an embodiment, for example, a first pattern of the present invention in FIG. 1 or a second pattern of the present invention in FIG. 4.

Alternatively, the contour measurement device 1 can be a display unit with a video camera installed which refers to the following process: download an image of the toilet seat's contour line 11 by the display unit; turn on the video camera; shift the video camera along a boundary contour of the flush toilet 2; the display unit indicates how the toilet seat's contour line 11 matches the boundary contour of the flush toilet 2 to decide a location of the toilet seat 3.

The mounting base 31 to be installed on the flush toilet 2 is separated from the main body at first; the mounting base 31 which is compact in volume and weight can be fixed and positioned at the flush toilet 2 by an installer. In order to measure positions of fixing the toilet seat 3 on the flush toilet 2 and the mounting base 31 of the toilet seat 3 on a fixed surface which is situated at the rear part of the flush toilet 2, an installer who performs installation and positioning may follow steps for measurement, installation and fixing as follows:

Step 1: Refer to FIG. 2 which illustrates a contour measurement device 1 comprising a toilet seat's contour line 11 and a mounting base's contour line 12 within the toilet seat's contour line 11.

Figure 3:
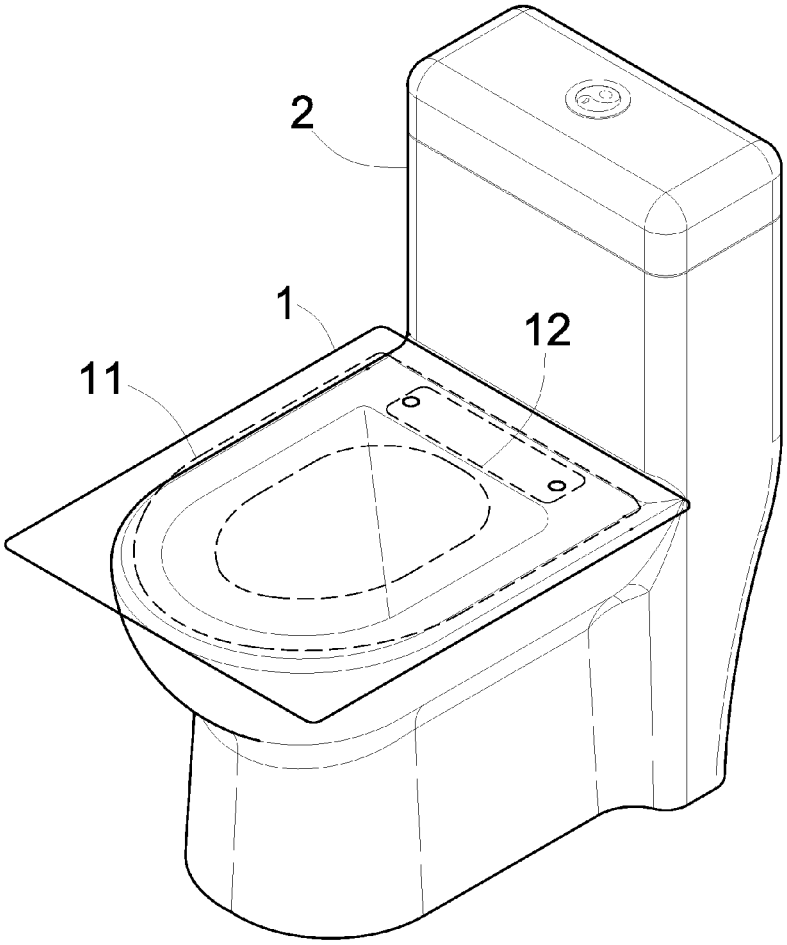
FIG. 3 is a schematic view which illustrates execution of the method to measure a flush toilet based on the contour measurement device in the first embodiment.
Figure 5:
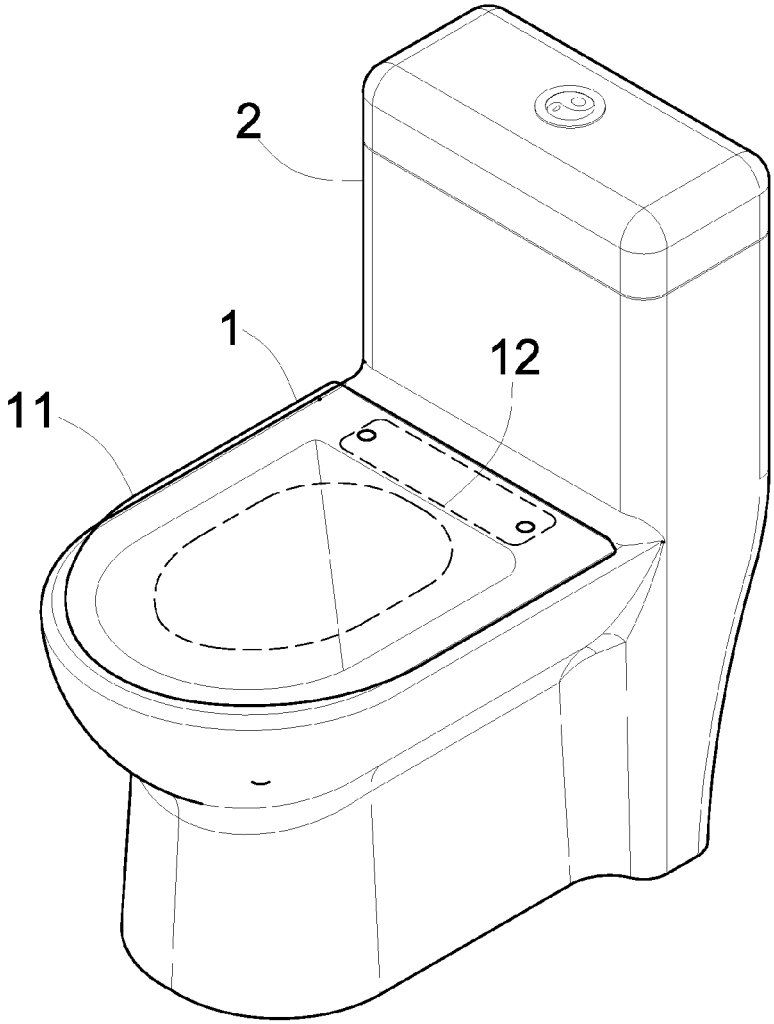
FIG. 5 is a schematic view which illustrates execution of a method to measure a flush toilet based on the contour measurement device in the second embodiment.

Step 2: Shift the toilet seat's contour line 11 on the contour measurement device 1 along a boundary contour of the flush toilet 2 on which a toilet seat 3 will be installed (FIG. 3 or FIG. 5); refer to the toilet seat's contour line 11 and the boundary contour of the flush toilet 2 as a basis to decide a location of the toilet seat 3 and a fixed location of the mounting base's contour line 12 on a mounting base 31 to be installed.

Figure 7:
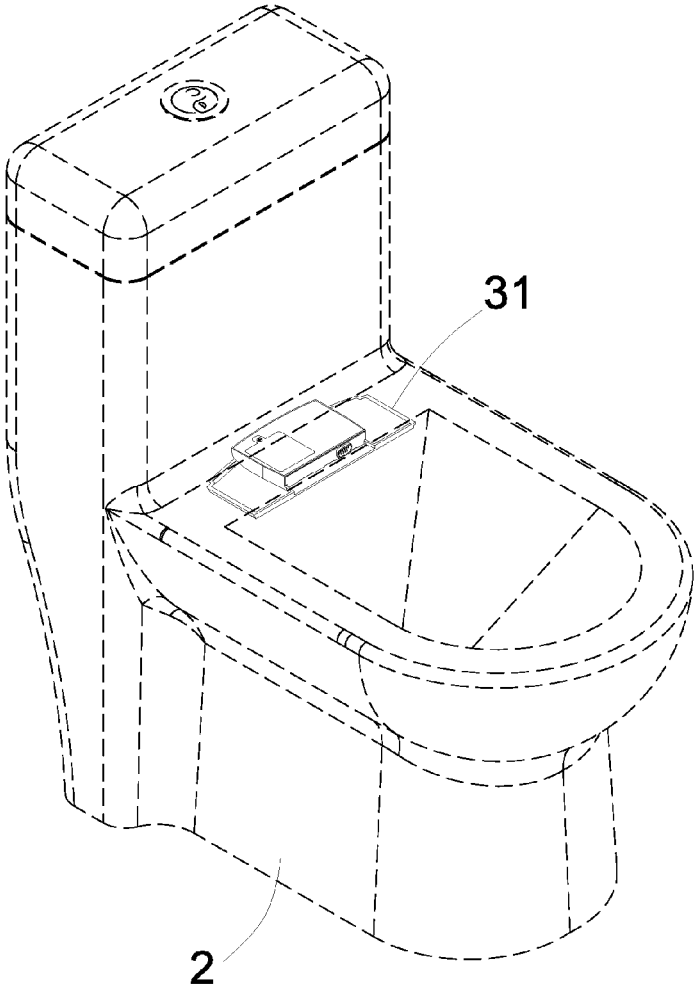
FIG. 7 is a schematic view which illustrates a mounting base which relies on an adhesive medium at the bottom to securely adhere to a flush toilet.

Step 3: Take the mounting base 31 over the fixed location of the mounting base's contour line 12; lower the mounting base 31 and align the mounting base 31 and the mounting base's contour line 12; make the mounting base 31 securely adhere to a fixed surface at the rear part of the flush toilet 2 by way of an adhesive medium 4 at the bottom of the mounting base 31 (FIG. 7).

Refer to the contour measurement device 1 made of paper, cloth or a plastic sheet, each of which is based on the transparent medium or the translucent medium. The contour measurement device 1 comprises at least the toilet seat's contour line 11 and at least the mounting base's contour line 12 which are available for the present invention in an embodiment.

In Step 2, an installer shifts the toilet seat's contour line 11 some distances at his (her) discretion along a boundary contour of the flush toilet 2 on which the toilet seat 3 will be installed until the toilet seat's contour line 11 locally overlaps the boundary contour (e.g., front side, left side and right side) of the flush toilet 2. If completed, an installer should check that an outline area at the fixed surface, which is situated at the rear part of the flush toilet 2 and overlapped by the mounting base's contour line 12 on the contour measurement device 1, is sufficient and securely adheres to the mounting base 31 or continuously shift the contour measurement device 1 to make sure of the outline area really matching the mounting base 31.

Alternatively, the present invention comprises a display unit with a video camera installed as the contour measurement device 1 which is based on an application method as follows: download an image of the toilet seat's contour line 11 by the display unit; turn on the video camera; shift the video camera some distances at discretion along a boundary contour of the flush toilet 2 until the toilet seat's contour line 11 locally overlaps the boundary contour; if completed, check the display unit to verify that an outline area of the fixed surface situated at the rear part of the flush toilet 2 and overlapped by the mounting base's contour line 12 on the contour measurement device 1 has a sufficient size to which the mounting base 31 securely adheres; otherwise, continuously shift the display unit with a video camera installed back and forth to make sure of the outline area with a sufficient size to which the mounting base 31 really adheres.

In Step 3, the adhesive medium 4 prepared at the bottom of the mounting base 31 is either an absorber or a glutinous substance. As one medium stuck on the fixed surface within the mounting base's contour line 12 on the flush toilet 2, the absorber has a sunken area centrally which develops vacuum under effect of ambient air and is not separated while adhering to the fixed surface of the flush toilet 2. The reusable glutinous substance mounted at the bottom of the mounting base 31 and developing a certain thickness can be repeatedly stuck at a proper position and prevents the mounting base 31 from damage. The glutinous substance is a thin adhesive which is made from multiple materials such as mineral oil, chemical resin, thermoplastic rubber and antioxidant and characteristic of repeatable paste like sticky notes.

Figure 6:
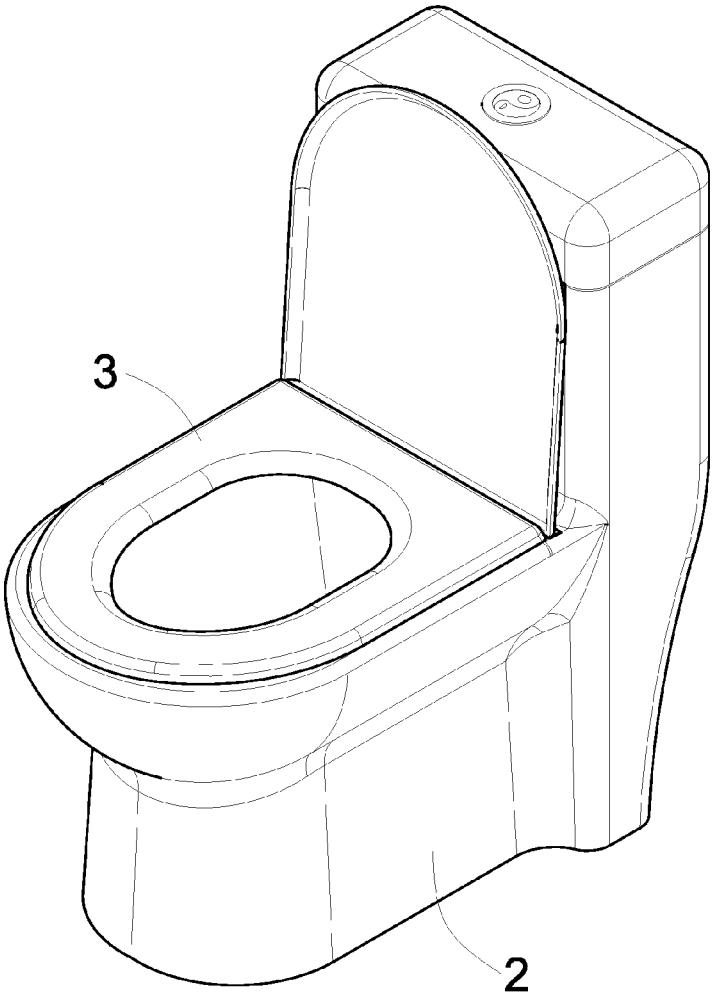
FIG. 6 is a schematic view illustrating a toilet seat which has been installed on a flush toilet.
Figure 9:
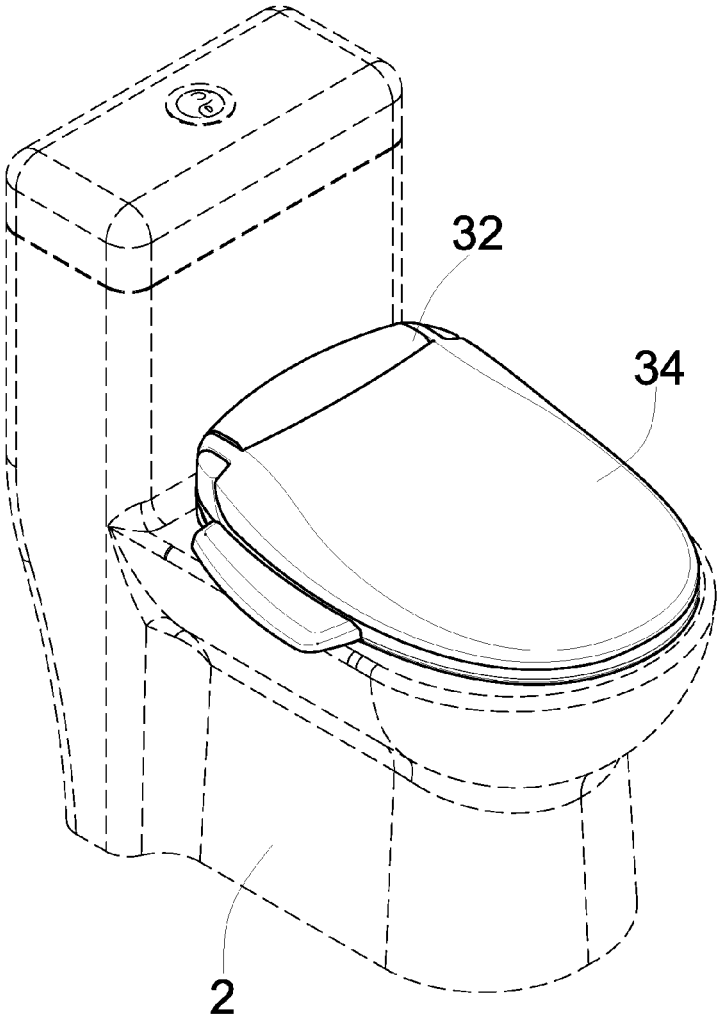
FIG. 9 is a schematic view illustrating a toilet seat which has been installed on a flush toilet.

As shown in FIG. 9, the main body 32 along with the toilet seat 3 can be placed on the flush toilet 2 on which the mounting base 31 has been installed. Finally, the computerized toilet seat 3 is completely assembled with the main body 32 of the toilet seat 3 and the mounting base 31 properly combined and positioned to each other. Moreover, FIG. 6 is a schematic view which illustrates the ordinary toilet seat 3 installed on the flush toilet 2.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A method to measure, install and fix a toilet seat, deciding locations of the toilet seat on a flush toilet and a mounting base of the flush toilet on a fixed surface at a rear part of the flush toilet, and comprising steps as follows:

giving a contour measurement device on which a toilet seat contour line and a mounting base contour line within said contour line are shown;

shifting said toilet seat contour line on said contour measurement device along a boundary contour of the flush toilet on which the toilet seat is installed and refers to said toilet seat contour line and said boundary contour as a basis to decide a location of said toilet seat and a fixed location of said mounting base's contour line for said mounting base to be installed; and taking said mounting base over said fixed location of said mounting base contour line, lowering said mounting base and aligning said mounting base and said mounting base contour line, and making said mounting base securely adhere to said fixed surface at said rear part by way of an adhesive medium at a bottom of said mounting base.

2. The method according to claim 1, wherein said contour measurement device is a transparent medium or a translucent medium made from plant fibers or chemical fibers and further comprises at least an exterior contour line of a lavatory seat and said mounting base contour line.

3. The method according to claim 1, wherein said contour measurement device is a transparent medium or a translucent medium which is made of a plastic material including plastic fiber, plastic paper, plastic cloth, plastic sheet, and plastic piece and further comprises said toilet seat contour line and said mounting base contour line.

4. The method according to claim 1, wherein said contour measurement device is a display unit with a video camera installed, which refers to a process as following: downloading an image of said toilet seat contour line by said display unit; turning on said video camera; shifting said video camera along said boundary contour of said flush toilet; said display unit indicating how said toilet seat contour line matches said boundary contour to decide a location of said toilet seat.

5. The method according to claim 1, wherein said adhesive medium is an absorber which is taken as one medium stuck on said fixed surface within said mounting base contour line and has a sunken area centrally that develops vacuum under effect of ambient air and is not separated while adhering to said fixed surface.

6. The method according to claim 1, wherein said mounting base comprises a reusable glutinous substance at bottom and with a specific thickness; said glutinous substance contributes to repeated adherence of said mounting base to a proper location without damage; said glutinous substance is a thermoplastic thin adhesive which is made from multiple materials including mineral oil, chemical resin, thermoplastic rubber and antioxidant.

* * * * *